US011171397B2

(12) United States Patent
Shi et al.

(10) Patent No.: US 11,171,397 B2
(45) Date of Patent: Nov. 9, 2021

(54) DIELECTRIC RESONATOR AND FILTER

(71) Applicant: HUAWEI TECHNOLOGIES CO., LTD., Guangdong (CN)

(72) Inventors: Jing Shi, Shanghai (CN); Guosheng Pu, Yokohama (JP)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/861,795

(22) Filed: Apr. 29, 2020

(65) Prior Publication Data

US 2020/0259236 A1 Aug. 13, 2020

Related U.S. Application Data

(63) Continuation of application No. PCT/CN2017/110868, filed on Nov. 14, 2017.

(51) Int. Cl.

| | |
|---|---|
| ***H01P 1/208*** | (2006.01) |
| ***H01P 7/10*** | (2006.01) |
| ***H01P 1/203*** | (2006.01) |

(52) U.S. Cl.

CPC ..... *H01P 1/2084* (2013.01); *H01P 1/20309* (2013.01); *H01P 7/10* (2013.01); *H01P 7/105* (2013.01)

(58) Field of Classification Search

CPC .... H01P 1/20309; H01P 1/20318; H01P 7/04; H01P 7/10; H01P 7/015

(Continued)

(56) References Cited

U.S. PATENT DOCUMENTS 4,652,843 A 3/1987 Tang et al.
5,859,574 A * 1/1999 Schmitt ..... H01P 7/10 333/202

(Continued)

FOREIGN PATENT DOCUMENTS

CN 1143858 A 2/1997
CN 1269914 A 10/2000

(Continued)

OTHER PUBLICATIONS

Youhei Ishikawa et al, "1.9 GHz Compact Low Loss Dielectric Duplexer Designed by Dual Mode Waveguide Transmission Line Method", Mar. 26, 2007, total 6 pages.

(Continued)

*Primary Examiner* — Rakesh B Patel
(74) *Attorney, Agent, or Firm* — Womble Bond Dickinson (US) LLP

(57) ABSTRACT

This application provides a dielectric resonator, including a dielectric body disposed in a hollow conductive housing, where the dielectric body includes a first end face and a second end face that are disposed opposite to each other and a circumferential surface connected between the first end face and the second end face. The first end face is provided with a first groove, the second end face is provided with a second groove, the first end face and the second end face are in contact with an inner wall of the conductive housing, and extension directions of the first groove and the second groove are different. This application further provides a filter. This application can implement single-sided installation of the dielectric resonator, so that an objective of miniaturization is achieved and assembly becomes easy. In addition, coupling between resonance modes can be enhanced because the extension directions of the first groove and the second groove are different.

19 Claims, 4 Drawing Sheets

(58) Field of Classification Search
USPC ..... 333/208–212, 219, 219.1
See application file for complete search history.

(56) References Cited

U.S. PATENT DOCUMENTS

| | | | |
|---|---|---|---|
| 6,507,254 | B1 | 1/2003 | Hattori et al. |
| 2016/0294030 | A1 | 10/2016 | Kwak et al. |

FOREIGN PATENT DOCUMENTS

| | | | |
|---|---|---|---|
| CN | 1297261 | A | 5/2001 |
| CN | 1486520 | A | 3/2004 |
| CN | 101803107 | A | 8/2010 |
| CN | 103633402 | A | 3/2014 |
| CN | 104577290 | A | 4/2015 |
| CN | 104995786 | A | 10/2015 |
| CN | 105406158 | A | 3/2016 |
| CN | 106129549 | A | 11/2016 |
| CN | 206148591 | U | 5/2017 |
| CN | 206225509 | U | 6/2017 |
| CN | 107146933 | A | 9/2017 |
| CN | 106688138 | B | 6/2019 |
| EP | 2833512 | A1 | 2/2015 |
| JP | H09148810 | A | 6/1997 |
| KR | 101468409 | B1 | 12/2014 |
| WO | 2014024349 | A1 | 2/2014 |

OTHER PUBLICATIONS

Michael Hoft and Thore Magath, "Compact Base-Station Filters Using TM-Mode Dielectric Resonators", Communications Laboratory of European Technology Center, (www.panasonic-eutc.com),Panasonic Electronic Devices Europe GmbH, Zeppelinstr. 19, D-21337 Lueneburg, Germany, total 4 pages.

J. Hattori et al, "2GHz band quadruple mode dielectric resonator filter for cellular base station", Jul. 15, 2003, total 4 pages.

J. J. Liu et al, "A multi-mode cavity filter with Jerusalem Cross structure resonator",2013 Asia-Pacific Microwave Conference Proceedings, total 3 pages.

Hai Hu et al, "A TM11 Dual-Mode Dielectric Resonator Filter With Planar Coupling Configuration", IEEE Transactions on Microwave Theory and Techniques, vol. 61, No. 1, Jan. 2013, total 8 pages.

S.J. Fiedziuszko,"Dual-Mode Dielectric Resonator Loaded Cavity Filters",IEEE Transactions on Microwave Theory and Techniques ( vol. 30 , Issue: 9 , Sep. 1982 ), total 6 pages.

Michael Hoft , "Hybrid TE/TM-Multi-Mode Resonators",Panasonic Electronic Devices Europe GmbH, Zeppelinstr. 19, D-21337 Lueneburg, Germany, total 4 pages.

Smain Amari et al, "New Dual-Mode Dielectric Resonator Filters",IEEE Microwave and Wireless Components Letters, vol. 15, No. 3, Mar. 2005, total 3 pages.

Jae-Yoon Myung et al, "Resonant Characteristics of Triple-Mode Dielectric Resonators",Journal of Electromagnetic Engineering and Science, vol. 14, No. 1, 9-14, Mar. 2014, total 6 pages.

Khawar Naeem, "Tolerance Analysis of a Multi-Mode Ceramic Resonator",Aug. 2013,Master s Thesis in Electronics, total 80 pages.

Zhou Chunxia et al.,"Analysis, Modeling and Design of Quadrate Dual Mode Bandpass Filters",Acta Electronica Sinica,vol. 39 ; No. 6,Jun. 2011, with an English abstract, total 4 pages.

* cited by examiner

DIELECTRIC RESONATOR AND FILTER

CROSS-REFERENCE TO RELATED APPLICATIONS

This application is a continuation of International Application No. PCT/CN2017/110868, filed on Nov. 14, 2017, the disclosure of which is hereby incorporated by reference in its entirety.

TECHNICAL FIELD

The present invention relates to a filter, and in particular, to a dielectric resonator applied in the filter.

BACKGROUND

As wireless communications technologies develop and a green base station concept that is for reducing environmental pollution is proposed, there are an increasing number of requirements for miniaturization of a radio frequency module. As an important component of the radio frequency module, a filter plays an important role in the field of high performance and miniaturization. A dielectric filter is characterized by miniaturization and high performance, and attracts more and more attention. When a current indicator is met, a small size and easy installation are typical requirements on a filter of a wireless base station.

SUMMARY

Embodiments of the present invention provide a dielectric resonator that is easy to install.

According to a first aspect, an embodiment the present invention provides a dielectric resonator, including a dielectric body disposed in a hollow conductive housing, where the dielectric body includes a first end face and a second end face that are disposed opposite to each other and a circumferential surface connected between the first end face and the second end face, the first end face is provided with a first groove, the second end face is provided with a second groove, the first end face and the second end face are in contact with an inner wall of the conductive housing, and extension directions of the first groove and the second groove are different.

In one embodiment, the first end face and the second end face of the dielectric resonator are grounded in a manner in which both the first end face and the second end face are in contact with the inner wall of the conductive housing, so that single-sided installation can be implemented and assembly is easy. Because the dielectric body of the dielectric resonator is in direct contact with the inner wall of the conductive housing, a structure between the dielectric body and the conductive housing is more compact, and there is no excessive hollow space. Therefore, an objective of miniaturization of a filter can be achieved. In some embodiments, different resonance modes of an electromagnetic field are formed by disposing the first groove and the second groove, and a coupling coefficient between the resonance modes can be adjusted because the extension directions of the first groove and the second groove are different.

In an embodiment, a conducting layer is disposed on a surface on which the first end face and the second end face are in contact with the conductive housing. Inner walls of the first groove and the second groove are dielectric surfaces and are not covered by a conducting layer.

In an embodiment, the extension directions of the first groove and the second groove are perpendicular to each other. In this case, two resonance modes with similar frequencies are formed, and there is no coupling between the two resonance modes or coupling strength between the two resonance modes is very low. The being perpendicular to each other described in some embodiments includes a state being perpendicular or a state close to being perpendicular. For example, that the being perpendicular to each other described in some embodiments may include a case in which an included angle is any value greater than or equal to 80 degrees and less than or equal to 90 degrees.

In an embodiment, the dielectric body has a central axis, the central axis falls on a connection line between a center of the first end face and a center of the second end face, and the central axis passes through the first groove and the second groove.

In an embodiment, notches are formed on the circumferential surface by disposing the first groove and the second groove. The forming notches on the circumferential surface means that the first groove and the second groove pass through the circumferential surface. In this embodiment, two orthogonal resonance modes can be formed by the first groove and the second groove passing through the circumferential surface.

Specifically, the notches include a first notch, a second notch, a third notch, and a fourth notch, the first notch and the second notch separately form two ends of the first groove, and the third notch and the fourth notch separately form two ends of the second groove.

In an embodiment, the dielectric body includes a first side wall and a second side wall that are located in the first groove and a first bottom wall connected between the first side wall and the second side wall, and the first side wall, the second side wall, and the first bottom wall are all of a planar shape. In this embodiment, the first groove may be a groove of a cuboid shape, or a cross section of the first groove may be a trapezoid or another shape, so that the first groove may be formed in a mechanical processing manner. Optionally, a shape of the second groove may be the same as a shape of the first groove.

In an embodiment, the dielectric body includes a first side wall and a second side wall that are located in the first groove and a first bottom wall connected between the first side wall and the second side wall, and the first side wall, the first bottom wall, and the second side wall are sequentially connected to form a smooth and continuously extending arc surface. In this embodiment, the first groove is of a cylindrical shape, may be prepared by using a die, and is easy to process.

In an embodiment, the circumferential surface of the dielectric body is a cylindrical surface.

In an embodiment, the dielectric body is of a cubic shape.

In an embodiment, both the first end face and the second end face are of a planar shape, and both are in direct surface contact with the inner wall of the conductive housing.

According to another aspect, this application further provides a filter, including the dielectric resonator according to any of the foregoing implementations.

BRIEF DESCRIPTION OF DRAWINGS

To describe technical solutions in embodiments of the present invention or in the background more clearly, the following describes the accompanying drawings required for describing the embodiments of the present invention or the background.

DESCRIPTION OF EMBODIMENTS

The following describes embodiments of the present invention with reference to the accompanying drawings in the embodiments of the present invention.

A dielectric resonator provided in some embodiments may be applied to a filter. The filter may be applied to a radio frequency front end of a radio frequency communications system or another apparatus or component that needs to use a filter, for example, a wireless communications device such as a network device or a terminal device.

Figure 1:
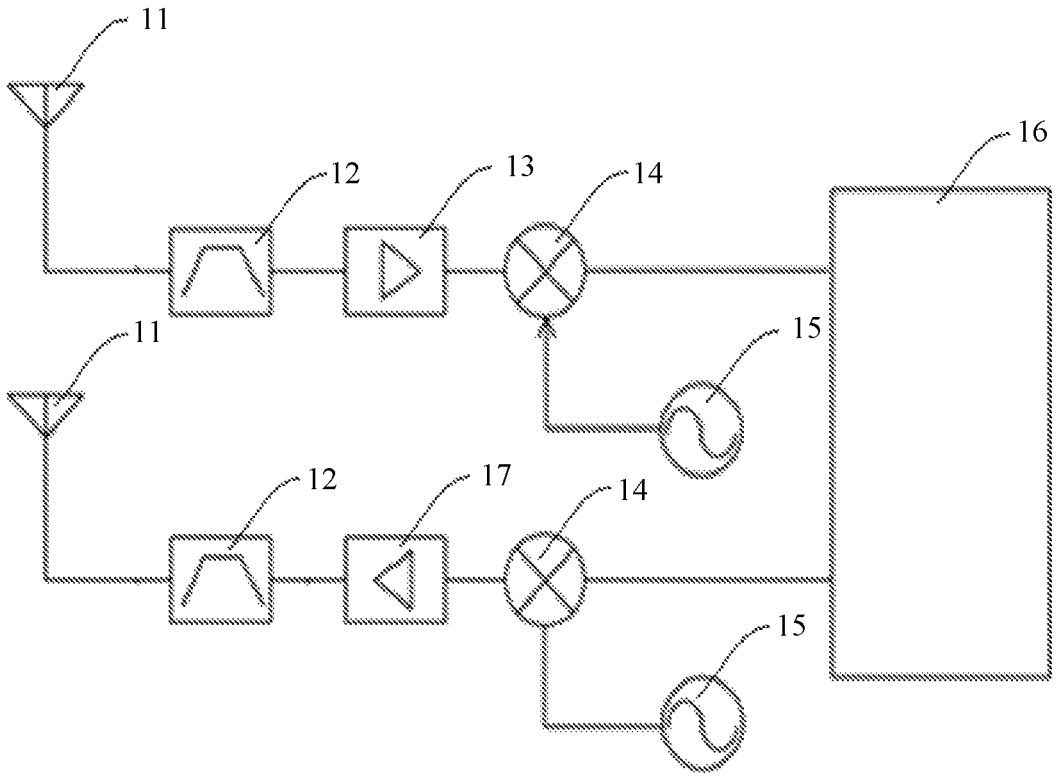
FIG. 1 is a schematic diagram of an application scenario of a dielectric resonator and a filter according to one embodiment.

As shown in FIG. 1, a radio frequency communications system includes two branches connected between antennas 11 and a baseband module 16. One branch includes an antenna 11, a filter 12, a noise amplifier 13, a frequency mixer 14, and a signal generator 15. The other branch includes an antenna 11, a filter 12, a power amplifier 17, a frequency mixer 14, and a signal generator 15. The antenna 11 is configured to receive and transmit an electromagnetic wave signal between the radio frequency communications system and external space. The filter 12 is configured to effectively filter out a specific frequency or a frequency other than the specific frequency. The filter 12 includes the dielectric resonator provided in some embodiments. The noise amplifier 13 may be a high-frequency or intermediate-frequency preamplifier of various radio receivers, or an amplification circuit of a high-sensitivity electronic detection device. The frequency mixer 14 is configured to convert a signal from a frequency to another frequency. The signal generator 15 is a device that can provide various frequencies, waveforms, and output level electrical signals, and is configured to generate an electrical signal. When an electronic circuit and a device are tested, researched, or adjusted, to measure some electrical parameters of the circuit, for example, measure a frequency response and a noise coefficient, and to calibrate a voltmeter, an electrical signal that meets a defined technical condition needs to be provided, to simulate an excitation signal of a to-be-tested device used in actual work. The power amplifier 17 is configured to generate the maximum power output to drive a load under a condition that a distortion rate is given. The baseband module 16 is configured to process a signal.

The filter provided in some embodiments includes at least one dielectric resonator. In a same filter, the dielectric resonator provided in some embodiments may be cascaded to a common resonator. In other words, the filter may include a common dielectric resonator and may further include the dielectric resonator provided in some embodiments. The common resonator and the dielectric resonator provided in some embodiments may be used in combination based on different application environments and requirements.

Figure 2:
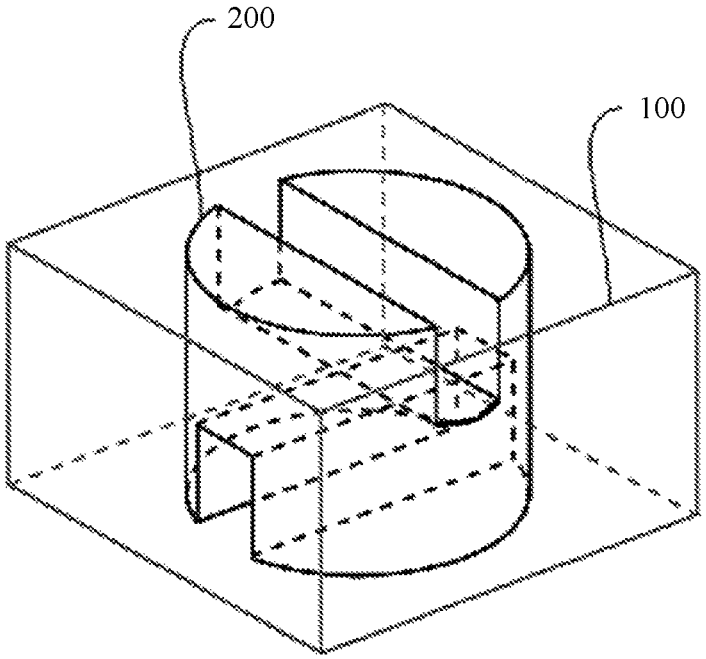
FIG. 2 is a schematic diagram in which a dielectric resonator is disposed in a conductive housing according to one embodiment.
Figure 3:
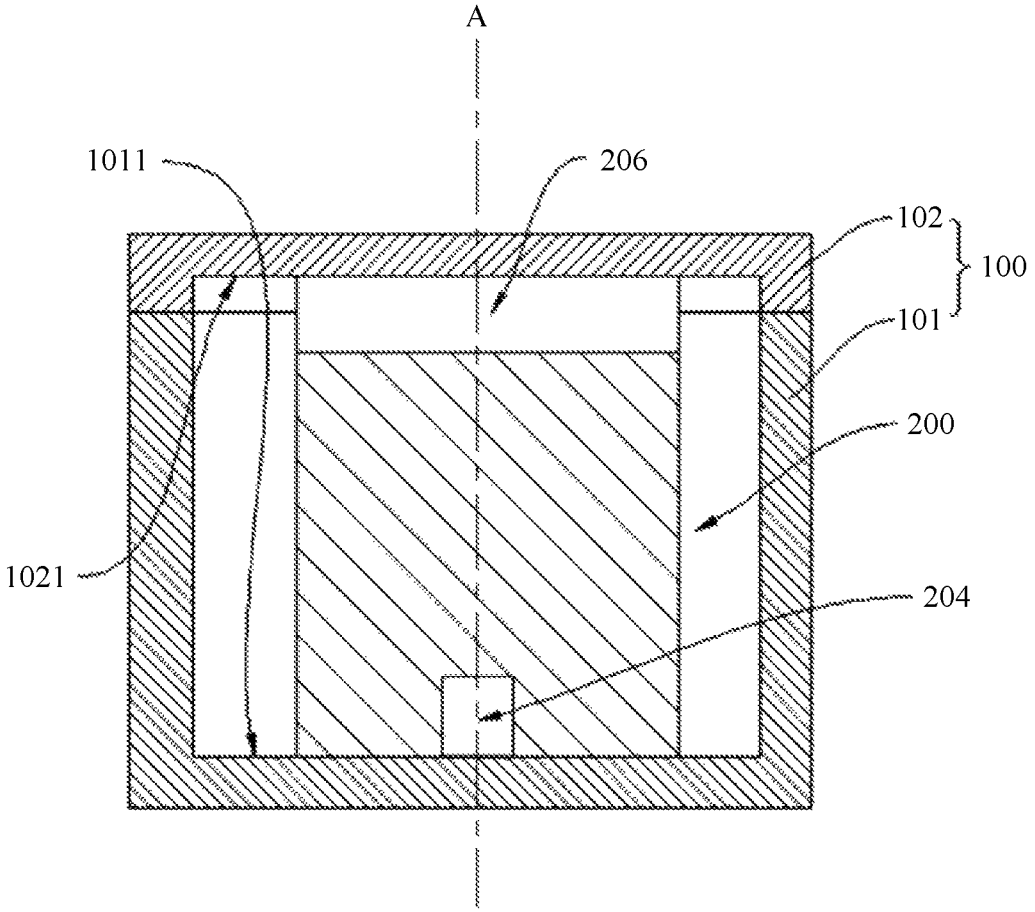
FIG. 3 is a schematic cross-sectional view of FIG. 2.

FIG. 2 and FIG. 3 are separately a schematic diagram and a schematic cross-sectional view in which a dielectric resonator is disposed in a conductive housing according to this application. The dielectric resonator includes a dielectric body 200 disposed in the hollow conductive housing 100. The hollow conductive housing 100 may be a housing of a filter, and may be made of a metal material. In an embodiment, the conductive housing is of a cubic structure. In another embodiment, the conductive housing may alternatively be of a spherical structure, a columnar structure, a multilateral structure, or the like. In an embodiment, as shown in FIG. 3, the conductive housing 100 includes a housing 101 and a cover 102. An inner side of the housing 101 is accommodation space, an end of the housing 101 forms an opening, and the dielectric resonator is installed into the housing 101 through the opening. The cover 102 is connected to an opening position of the housing 101, and forms a closed box structure together with the housing 101. A cuboid-shaped box structure shown in FIG. 2 represents the conductive housing 100. The housing of the filter in an actual application environment is not necessarily of a shape shown in FIG. 2, and may be of any shape provided that the housing has a conductive function, and the housing may be made of a non-metal conducting material.

Figure 4:
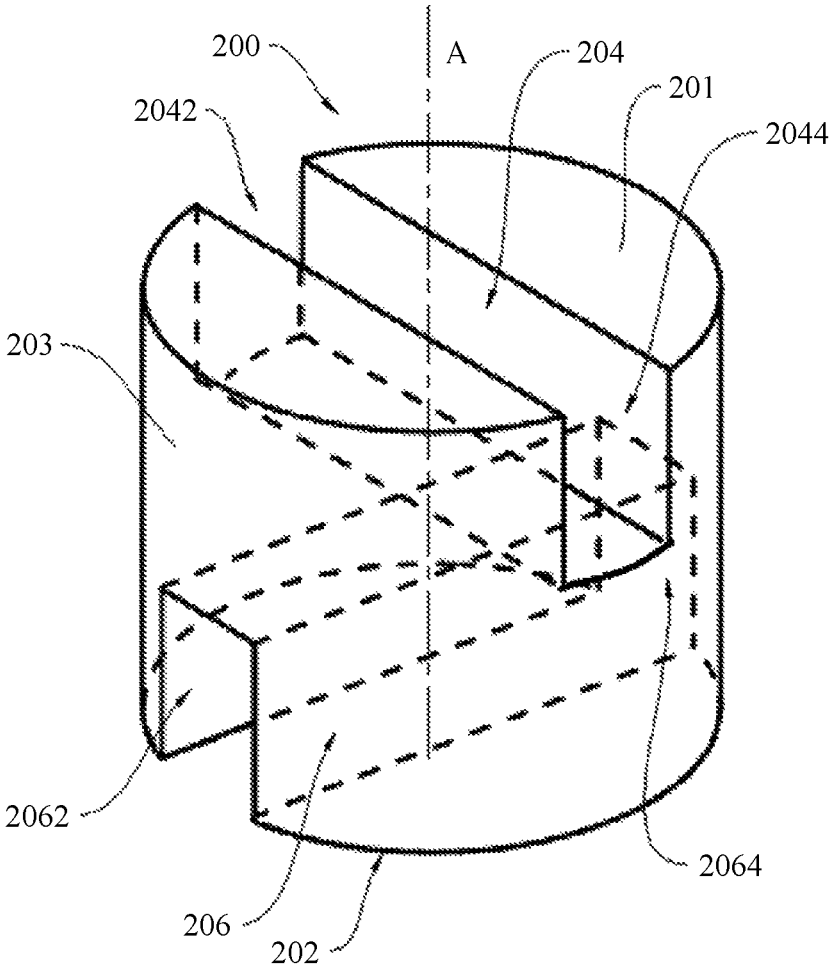
FIG. 4 is a schematic diagram of a dielectric body of a dielectric resonator according to one embodiment.

Referring to FIG. 3 and FIG. 4, the dielectric body 200 includes a first end face 201 and a second end face 202 that are opposite to each other and a circumferential surface 203 connected between the first end face 201 and the second end face 202. The first end face 201 is provided with a first groove 204, the second end face 202 is provided with a second groove 206, the first end face 201 and the second end face 202 are in contact with an inner wall of the conductive housing 100, and extension directions of the first groove 204 and the second groove 206 are different. When the first groove 204 and the second groove 206 are perpendicularly projected on a same plane, a projection of the first groove 204 intersects a projection of the second groove 206.

Specifically, the first end face 201 is in contact with a bottom wall 1011 of the housing 101 of the conductive housing 100, the second end face 202 is in contact with an inner surface 1021 of the cover 102 of the conductive housing 100, and the inner surface 1021 of the cover 102 is disposed opposite to the bottom wall 1011 of the housing 101. Optionally, in one embodiment, the dielectric body 200 of the dielectric resonator is fixed in the conductive housing 100 in an installation manner of crimping the cover 102 on the second end face 202. In an embodiment, a ground connection relationship is formed both between the first end face 201 and the bottom wall 1011 and between the second end face 202 and the cover 102. In an embodiment, a conducting layer, for example, a metal layer, is disposed on a surface on which the first end face 201 and the second end face 202 are in contact with the conductive housing 100.

In one embodiment, the first end face 201 and the second end face 202 of the dielectric resonator are grounded in a manner in which both the first end face 201 and the second end face 202 are in contact with the inner wall of the conductive housing 100, so that single-sided installation can be implemented and assembly is easy. In other words, the dielectric body 200 of the dielectric resonator is first placed into the housing 101 of the conductive housing 100, and then, the cover 102 is fixed to the housing 101, and the dielectric body 200 of the dielectric resonator is fixed in the conductive housing 100. To ensure an abutting relationship between the first end face 201 and the conductive housing 100 and between the second end face 202 and the conductive housing 100, a conductive elastomer may be disposed between the first end face 201 and the conductive housing 100 or between the second end face 202 and the conductive housing 100, to overcome an installation gap tolerance through elastic deformation of the conductive elastomer, thereby ensuring that the dielectric body 200 of the dielectric resonator is fixed at a position inside the conductive housing 100.

Because the dielectric body 200 of the dielectric resonator is in direct contact with the inner wall of the conductive housing 100 through the first end face 201 and the second end face 202, a structure between the dielectric body 200 and the conductive housing 100 is more compact, and there is no excessive hollow space. Therefore, an objective of miniaturization of the filter can be achieved.

In one embodiment, different resonance modes of an electromagnetic field are formed by disposing the first groove 204 and the second groove 206, and a coupling coefficient between the resonance modes can be adjusted because the extension directions of the first groove 204 and the second groove 206 are different.

The extension directions of the first groove 204 and the second groove 206 are different. For example, both the first groove 204 and the second groove 206 are strip-shaped, the first groove 204 extends on the first end face 201, the second groove 206 extends on the second end face 202, the first groove 204 and the second groove 206 extend in a direction parallel to the first end face and the second end face, and a direction in which the first groove 204 extends and a direction in which the second groove 206 extends are not parallel. That the extension directions are different described in this specification may be understood as follows: When the first end face or the second end face is parallel to an XY plane of a rectangular coordinate system, the two grooves 204 and 206 are perpendicularly projected on the XY plane, and a projection of the first groove 204 on the XY plane intersects a projection of the second groove 206 on the XY plane to form a specific included angle. Optionally, an intersection point of the projection of the first groove 204 on the XY plane and the projection of the second groove 206 on the XY plane falls within a projection range of the first end face or the second end face on the XY plane. That the extension directions are different described in this specification may alternatively be understood as follows: A projection of the second groove 206 on the first end face 201 intersects with the first groove 204 to form a specific included angle, or a projection of the first groove 204 on the second end face 202 intersects with the second groove 206 to form a specific included angle. By adjusting the included angle formed between the extension directions of the first groove 204 and the second groove 206, a coupling bandwidth between modes of the dielectric resonator may be controlled. For example, when the included angle is 90 degrees, coupling approaches 0, and the coupling between two modes may be enhanced by reducing the included angle. Therefore, in some embodiments, the coupling bandwidth can still be flexibly controlled in narrow space, to implement a required operating bandwidth.

In an embodiment, the extension directions of the first groove 204 and the second groove 206 are perpendicular to each other, in other words, the included angle between the extension directions of the first groove 204 and the second groove 206 is close to 90 degrees. In this case, two resonance modes with similar frequencies are formed, and there is no coupling between the two resonance modes or coupling strength between the two resonance modes is very low. Certainly, the being perpendicular to each other described herein in some embodiments may be understood as a state close to being perpendicular, and is not absolutely 90 degrees. In other words, an angle deviation within a specific range may be tolerated. For example, the angle may be any value from 80 degrees to 90 degrees. The included angle described in some embodiments is an acute angle or a right angle formed when the extension directions of the first groove and the second groove intersect. A range of the included angle may be any value between 0 degrees and 90 degrees, and includes the 90 degrees.

In one embodiment, the first groove 204 and the second groove 206 are crossed to form a dual-mode form. Compared with a single-mode dielectric resonator, the dielectric resonator in some embodiments has a high electric field density, and compared with a dielectric resonator with a same volume, the dielectric resonator in some embodiments has a higher Q value.

In an embodiment, the dielectric body 200 has a central axis A, the central axis A falls on a connection line between a center of the first end face 201 and a center of the second end face 202, and the central axis A passes through the first groove 204 and the second groove 206. For example, a central position of the first groove 204 and/or a central position of the second groove 206 falls on the central axis A. In an embodiment, the central position of the first groove 204 and the central position of the second groove 206 each fall on the central axis A, and the first end face 201 and the second end face 202 of the dielectric resonator in this embodiment each form a symmetric structure, and is beneficial for even electric field distribution. In addition, for a symmetric design structure that uses the central axis A as a center, a same resonance effect can be implemented in any installation direction. Therefore, the dielectric resonator provided in this embodiment is easier to install.

In an embodiment, a central position of one of the first groove 204 and the second groove 206 falls on the central axis A, and a central position of the other one deviates from the central axis A.

In an embodiment, notches are formed on the circumferential surface 203 by disposing the first groove 204 and the second groove 206. In an embodiment shown in the accompanying drawings of this application, the first groove 204 and the second groove 206 each form two notches on the circumferential surface 203, to be specific, both of two ends of the first groove 204 and two ends of the second groove 206 pass through the circumferential surface 203, so that two orthogonal resonance modes can be formed.

The first groove 204 may form two notches on the circumferential surface, that is, a first notch 2042 and a second notch 2044. The first notch 2042 and the second notch 2044 separately form the two ends of the first groove 204. Similarly, the second groove 206 may also form two notches on the circumferential surface, that is, a third notch 2062 and a fourth notch 2064. The third notch 2062 and the fourth notch 2064 separately form the two ends of the second groove 206. In another embodiment, the first groove 204 may form only one notch on the circumferential surface, in other words, only one end of the first groove 204 extends to the circumferential surface 203, and the other end is cut off on the first end face 201, and no through channel is formed. The second groove 206 may also form only one notch on the circumferential surface 203, in other words, only one end of the second groove 206 extends to the circumferential surface 203, and the other end is cut off on the second end face 202, and no through channel is formed.

Optionally, the first groove 204 may form no notch on the circumferential surface, in other words, both of the two ends of the first groove 204 are cut off on the first end face 201. Similarly, the second groove 206 may form no notch on the circumferential surface 203, in other words, both of the two ends of the second groove 206 are cut off on the second end face 202.

Optionally, a structure such as a protrusion or a partition may be further disposed inside the first groove 204 and/or the second groove 206 based on a requirement.

A shape of a cross section of the first groove 204 may be a semicircle, a rectangle, a triangle, an irregular shape, or the like. The cross section of the first groove 204 refers to a cross section of the first groove 204 that is perpendicular to the extension direction of the first groove 204. Similarly, a shape of a cross section of the second groove 206 may be a semicircle, a rectangle, a trapezoid, a triangle, an irregular shape, or the like. Shapes of cross sections of the first groove 204 and the second groove 206 may be the same or may be different.

Figure 5:
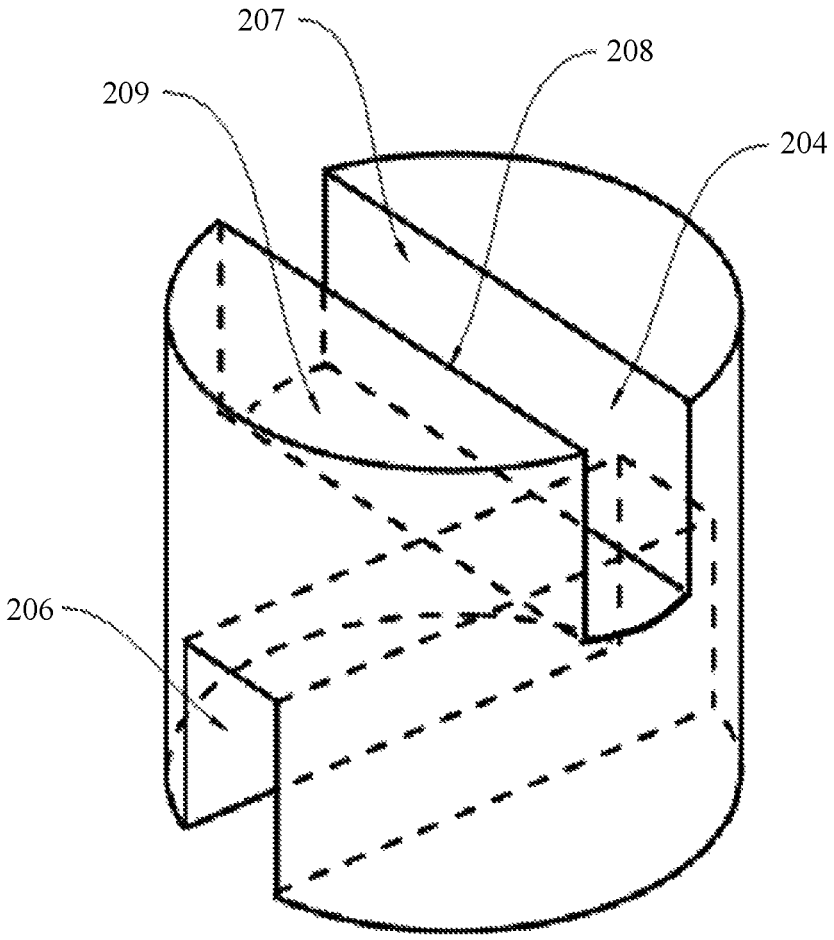
FIG. 5 is a schematic diagram of a dielectric body of a dielectric resonator according to one embodiment.

Referring to FIG. 5, in an embodiment, the dielectric body 200 includes a first side wall 207 and a second side wall 208 that are located in the first groove 204 and a first bottom wall 209 connected between the first side wall 207 and the second side wall 208, and the first side wall 207, the second side wall 208, and the first bottom wall 209 are all of a planar shape. In this embodiment, the first groove 204 may be a groove of a cuboid shape. Certainly, a cross section of the first groove 204 also needs to be a trapezoid, and the first groove 204 may be formed in a mechanical processing manner. A shape of the second groove 206 may be the same as a shape of the first groove 204.

In another embodiment, the first side wall 207, the first bottom wall 209, and the second side wall 207 may alternatively be sequentially connected to form a smooth and continuously extending arc surface, for example, similar to a semi-cylindrical surface. In this embodiment, the first groove 204 is of a cylindrical shape, may be prepared by using a die, and is easy to process.

The dielectric body may be of a cubic shape or a cylindrical shape. In an embodiment, the circumferential surface of the dielectric body is a cylindrical surface. Both the first end face and the second end face are of a planar shape, and both are in direct surface contact with the inner wall of the conductive housing. In this embodiment, a manner in which planes are directly contacted helps implement a design of miniaturization of the dielectric resonator, and has a good grounding effect.

The first groove 204 and the second groove 206 are configured to change magnetic field distribution of resonance modes, and control a coupling bandwidth of each resonance mode according to one embodiment. When the included angle between the extension directions of the first groove 204 and the second groove 206 is close to 90 degrees or is 90 degrees, a coupling coefficient between the resonance modes approaches 0, and coupling is weak coupling. When the included angle between the extension directions of the first groove and the second groove is close to 0 degrees or is 0 degrees, a coupling coefficient between the resonance modes approaches the maximum value, and coupling is strong coupling.

In one embodiment, a size of a cross section of the first groove 204 and a size of a cross section of the second groove 206 may be further adjusted, to adjust a change degree of electromagnetic field distribution of the dielectric resonator, and further control coupling strength between the resonance modes.

Optionally, other parts of the first end face 201 and the second end face 202, except the parts on which the first groove 204 and the second groove 206 are disposed, are of a planar shape, and are in full contact with the inner wall of the conductive housing, that is, in surface contact, thereby implementing a good grounding effect and also simplifying installation.

The dielectric resonator provided in one embodiment may generate two resonance modes with similar frequencies, and has a basic condition for making a multimode filter. The dielectric resonator provided in one embodiment has a high electric field density, and a Q value of the dielectric resonator is about 30% higher than a Q value of a TM single-mode with a same volume.

What is claimed is:

1. A dielectric resonator, comprising a dielectric body disposed in a hollow conductive housing, wherein the dielectric body comprises a first end face and a second end face that are opposite to each other and a circumferential surface connected between the first end face and the second end face, the first end face is provided with a first groove, the second end face is provided with a second groove, the first end face and the second end face are in contact with an inner wall of the conductive housing, and extension directions of the first groove and the second groove are different.

2. The dielectric resonator according to claim 1, wherein when the first groove and the second groove are perpendicularly projected on a same plane, a projection of the first groove intersects a projection of the second groove.

3. The dielectric resonator according to claim 1, wherein the first end face further comprises a conducting layer disposed on a surface on which the first end face is in contact with the conductive housing and the second end face further comprises a conducting layer disposed on a surface on which the second end face is in contact with the conductive housing.

4. The dielectric resonator according to claim 1, wherein the extension directions of the first groove and the second groove are perpendicular to each other.

5. The dielectric resonator according to claim 1, wherein the dielectric body has a central axis, the central axis is in line with a connection line between a center of the first end face and a center of the second end face, and the central axis passes through the first groove and the second groove.

6. The dielectric resonator according to claim 1, wherein the first groove and the second groove form notches on the circumferential surface.

7. The dielectric resonator according to claim 6, wherein the notches comprise a first notch, a second notch, a third notch, and a fourth notch, the first notch and the second notch are two ends of the first groove, and the third notch and the fourth notch are two ends of the second groove.

8. The dielectric resonator according to claim 1, wherein the dielectric body comprises a first side wall and a second side wall that are located in the first groove and a first bottom wall connected between the first side wall and the second side wall, and wherein the first side wall, the second side wall, and the first bottom wall are all of a planar shape.

9. The dielectric resonator according to claim 1, wherein the dielectric body comprises a first side wall and a second side wall that are located in the first groove, and a first bottom wall connected between the first side wall and the second side wall, and wherein the first side wall, the first bottom wall, and the second side wall are sequentially connected to form a smooth and continuously extending arc surface.

10. The dielectric resonator according to claim 1, wherein the circumferential surface of the dielectric body is a cylindrical surface.

11. The dielectric resonator according to claim 1, wherein the dielectric body is of a cubic shape.

12. The dielectric resonator according to claim 1, wherein both the first end face and the second end face are of a planar shape, and both are in surface contact with the inner wall of the conductive housing.

13. A filter comprising a dielectric resonator, the dielectric resonator comprising a dielectric body disposed in a hollow conductive housing, wherein the dielectric body comprises a first end face and a second end face that are opposite to each other and a circumferential surface connected between the first end face and the second end face, the first end face is provided with a first groove, the second end face is provided with a second groove, the first end face and the second end face are in contact with an inner wall of the conductive housing, and extension directions of the first groove and the second groove are different.

14. The filter according to claim 13, wherein when the first groove and the second groove are perpendicularly projected on a same plane, a projection of the first groove intersects a projection of the second groove.

15. The filter according to claim 13, wherein the first end face further comprises a conducting layer disposed on a surface on which the first end face is in contact with the conductive housing and the second end face further comprises a conducting layer disposed on a surface on which the second end face is in contact with the conductive housing.

16. The filter according to claim 13, wherein the extension directions of the first groove and the second groove are perpendicular to each other.

17. The filter according to claim 13, wherein the dielectric body has a central axis, the central axis is in line with a connection line between a center of the first end face and a center of the second end face, and the central axis passes through the first groove and the second groove.

18. The filter according to claim 13, wherein the first groove and the second groove form notches on the circumferential surface.

19. The filter according to claim 18, wherein the notches comprise a first notch, a second notch, a third notch, and a fourth notch, the first notch and the second notch are two ends of the first groove, and the third notch and the fourth notch are two ends of the second groove.

* * * * *